US007492098B2

(12) United States Patent
Kakehashi et al.

(10) Patent No.: US 7,492,098 B2
(45) Date of Patent: Feb. 17, 2009

(54) COIL ASSEMBLY BODY STRUCTURE FOR ELECTRODELESS DISCHARGE LAMP

(75) Inventors: Hidenori Kakehashi, Takatsuki (JP); Shohei Yamamoto, Toyonaka (JP); Koji Hiramatsu, Neyagawa (JP); Shinji Hizuma, Mito (JP); Keisuke Harada, Himeji (JP); Yoshinobu Shibata, Himeji (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 357 days.

(21) Appl. No.: 10/576,710

(22) PCT Filed: Oct. 24, 2003

(86) PCT No.: PCT/JP03/13672

§ 371 (c)(1),
(2), (4) Date: Apr. 21, 2006

(87) PCT Pub. No.: WO2005/041245

PCT Pub. Date: May 6, 2005

(65) Prior Publication Data

US 2007/0069647 A1 Mar. 29, 2007

(51) Int. Cl.

| | |
|---|---|
| ***H01J 11/00*** | (2006.01) |
| ***H01J 17/00*** | (2006.01) |
| ***H01J 61/00*** | (2006.01) |
| ***H01J 61/28*** | (2006.01) |
| ***H01K 1/50*** | (2006.01) |

(52) U.S. Cl. ..... 313/567; 313/231.01; 313/31; 313/634

(58) Field of Classification Search ..... 313/238, 313/231.01, 31, 160, 634, 493

See application file for complete search history.

(56) References Cited

U.S. PATENT DOCUMENTS 4,568,859 A * 2/1986 Houkes et al. ..... 315/248

(Continued)

FOREIGN PATENT DOCUMENTS

JP 53-105076 9/1978

(Continued)

OTHER PUBLICATIONS

English language Abstract of JP 2003-257379.

(Continued)

*Primary Examiner*—Karabi Guharay
*Assistant Examiner*—Kevin Quarterman
(74) *Attorney, Agent, or Firm*—Greenblum & Bernstein, P.L.C.

(57) ABSTRACT

An electrodeless discharge lamp comprising: an airtight container bulb made of a transparent material and enclosing a discharge gas; and a coupler (coil assembly body), contained in a cavity formed in the bulb, for generating a high frequency electromagnetic field by conducting a high frequency current in a coil to excite the discharge gas so as to emit light, wherein the coupler comprises: a pipe-shaped cylinder formed of a thermal conductor for heat release; a skeleton-shaped bobbin mounted on an outer surface of the cylinder along an axial direction of the cylinder; a core made of a soft magnetic material provided at an opening formed by the skeleton of the bobbin and being in substantial surface contact with the cylinder; and a coil wound around a surface of the skeleton-shaped bobbin and the core. Thus, the core provided at the opening formed by the skeleton is in substantial surface contact with the cylinder for heat release, so that heat received by the coil from the heat-generating bulb is directly exhausted to the cylinder through the core.

20 Claims, 15 Drawing Sheets

U.S. PATENT DOCUMENTS

| | | | | | |
|---|---|---|---|---|---|
| 4,927,217 | A | * | 5/1990 | Kroes et al. | 315/248 |
| 5,291,091 | A | * | 3/1994 | Eggink et al. | 313/161 |
| 5,336,971 | A | * | 8/1994 | Vermeulen et al. | 313/635 |
| 5,412,280 | A | * | 5/1995 | Scott et al. | 313/573 |
| 5,461,284 | A | * | 10/1995 | Roberts et al. | 315/57 |
| 5,637,963 | A | * | 6/1997 | Inoue et al. | 315/248 |
| 5,723,941 | A | * | 3/1998 | Roelevink | 313/493 |
| 5,760,547 | A | * | 6/1998 | Borowiec | 315/248 |
| 5,783,912 | A | * | 7/1998 | Cocoma et al. | 315/248 |
| 5,801,493 | A | | 9/1998 | Antonis et al. | |
| 5,912,536 | A | * | 6/1999 | Michiels et al. | 315/248 |
| 6,066,921 | A | | 5/2000 | Nakamura et al. | |
| 6,605,889 | B2 | * | 8/2003 | Anami et al. | 313/153 |

FOREIGN PATENT DOCUMENTS

| | | |
|---|---|---|
| JP | 11-501152 | 1/1999 |
| JP | 2003-257379 | 9/2003 |
| WO | 97/ 23895 | 7/1997 |

OTHER PUBLICATIONS

English language Abstract of JP 53-105076.

* cited by examiner

COIL ASSEMBLY BODY STRUCTURE FOR ELECTRODELESS DISCHARGE LAMP

TECHNICAL FIELD

The present invention relates to an electrodeless discharge lamp which excites, by a high frequency electromagnetic field, a discharge gas enclosed in an airtight container so as to emit light.

BACKGROUND ART

A conventionally known apparatus of an electrodeless discharge lamp of this kind comprises: an airtight container bulb made of a transparent material and enclosing a discharge gas such as mercury or argon; and an induction coil apparatus which is contained in a hollow portion (hereafter referred to as cavity) provided in this bulb, and which generates a high frequency electromagnetic field by conducting a high frequency current to excite the discharge gas so as to emit light, as shown, for example, in Japanese-translated Laid-open Publication of International Patent Application Hei 11-501152. This induction coil apparatus is formed of an assembly body (hereafter referred to as coupler) of: a coil for generating electromagnetic energy by current conduction; a core made of a soft magnetic material; and a thermal conductor (hereafter referred to as cylinder) for heat release. This kind of electrodeless discharge lamp has advantages that it has a long life because it has no electrode, and that it has good lighting-up responsiveness, and further that it is easy to airtightly seal a glass bulb, and is easy to assemble. However, at the same time, the core positioned in the cavity and formed of a coil and a soft magnetic material is exposed to heat from the bulb while lit. Accordingly, loss due to an increase in coil resistance and reduction in reliability of a coil insulation material become problems, which requires design for heat exhaustion to be devised.

In the electrodeless discharge lamp shown in the above-described Japanese-translated Laid-open Publication of International Patent Application Hei 11-501152, attention is paid to the relationship of the arrangement between a ferrite core and a cylinder in order to increase the heat exhaustion effect by thermal conductor. More specifically, it is described that the heat exhaustion effect is increased by arranging an aluminum-made cylinder in a manner to contain a ferrite core, and by controlling the cross-sectional area ratio between the core and the cylinder.

However, in this electrodeless discharge lamp, a resin-made bobbin for winding the coil is provided to cover the core and the cylinder, in which the resin-made bobbin is poor in thermal conductivity, and in addition cannot prevent an air layer from intervening therebetween when mounted on the core and the cylinder. Air is very poor in thermal conductivity. As a result, it is not possible to effectively exhaust heat of the coil received from the heat-generating bulb. Thus, the coil temperature markedly increases, making it impossible to prevent the reliability of the coil insulation from being reduced. Further, a divided ferrite core is used, which causes the shape of the cylinder to be complex in order to fix such core. Furthermore, although it is possible to consider a structure in which the coil is wound around the core without using a resin-made bobbin, the positional accuracy of the coil is likely to decrease, making it likely that the lighting performance is caused to vary.

DISCLOSURE OF INVENTION

The present invention is to solve the above-described problems, and has an object to provide an electrodeless discharge lamp with a simple structure which can effectively exhaust heat of a coil received from a heat-generating bulb, with good heat exhaustion property and heat releasing property, and which achieves improvement of the reliability of the coil insulation as well as reduction of the variation in the lighting performance.

To achieve the above object, the present invention is an electrodeless discharge lamp comprising: an airtight container bulb made of a transparent material and enclosing a discharge gas; and a coil assembly body (hereafter referred to as coupler), contained in a hollow portion (hereafter referred to as cavity) provided in the bulb, for generating a high frequency electromagnetic field by conducting a high frequency current in a coil to excite the discharge gas so as to emit light, wherein the coupler comprises: a pipe-shaped cylinder formed of a thermal conductor for heat release; a skeleton-shaped bobbin mounted on an outer surface of the cylinder along an axial direction of the cylinder; a core made of a soft magnetic material provided at an opening formed by the skeleton of the bobbin and being in substantial surface contact with the cylinder; and a coil wound around a surface of the skeleton-shaped bobbin and the core.

According to the present invention, the coil is wound around the surface of the skeleton-shaped bobbin and the core, and the core provided at the opening formed by the skeleton is in substantial surface contact with the cylinder for heat release, so that heat received by the coil from the heat-generating bulb is directly exhausted to the cylinder through the core. This causes good heat exhaustion property and heat releasing property, and achieves improvement of the reliability of the coil insulation as well as reduction of the variation in the lighting performance.

The skeleton-shaped bobbin of the coupler can be made of resin. When referring to a part of the bobbin positioned back in the cavity as a bobbin upper part, and referring to its part positioned at an opening portion of the cavity as a bobbin lower part, the bobbin can comprise: a substantially doughnut-shaped upper collar; at least two pillar portions extending in a direction from this upper collar to the bobbin lower part; and a cylindrical lower collar supporting these pillar portions and extending to be the bobbin lower part, in which the upper collar, the pillar portions and the lower collar support the core and the coil.

BRIEF DESCRIPTION OF DRAWINGS

FIG. 2B is a perspective view showing a state in which the bobbin is coupled to the cylinder with a core being additionally mounted, while

FIG. 3A is a front view of the skeleton-shaped bobbin, while

FIG. 6A is a view showing a structure of a groove of the bobbin for pulling-out the coil, while

FIG. 8A is a perspective view of an end portion at beginning of the winding of the coil according to still another example, while

FIG. 10A is a perspective view of an upper half of a skeleton-shaped bobbin of the same lamp, while

FIG. 14A is a perspective view showing an end portion at beginning of the winding of a coil (showing of the core being omitted), while FIG. 15A is a perspective view showing connection of one coil lead line to a cable in the coupler, while

BEST MODE FOR CARRYING OUT THE INVENTION

Hereinafter, electrodeless discharge lamps according to embodiments of the present invention will be described with reference to the drawings.

FIRST EMBODIMENT

Figure 1:
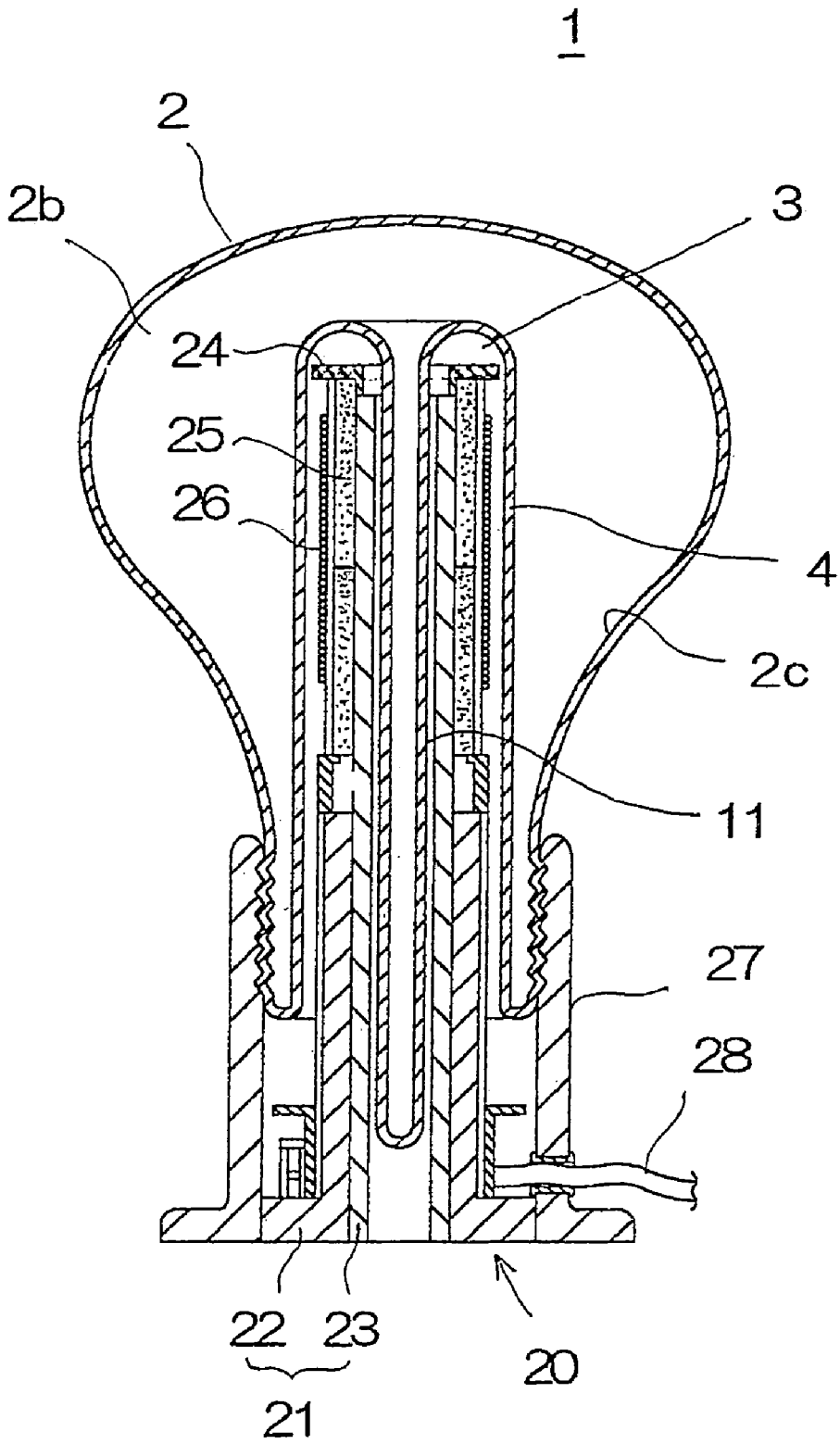
FIG. 1 is a cross-sectional view of an electrodeless discharge lamp according to First Embodiment of the present invention.

FIG. 1 to FIG. 8 show an electrodeless discharge lamp according to First Embodiment of the present invention. As shown in FIG. 1, the electrodeless discharge lamp 1 comprises: an airtight container bulb 2 made of a transparent material and enclosing a discharge gas; and a coil assembly body 20 (hereafter referred to as coupler) for generating a high frequency electromagnetic field by conducting a high frequency current in a coil 26 to excite the discharge gas so as to emit light. This coupler 20 is separably contained in a hollow portion 3 (hereafter referred to as cavity) formed in the bulb 2 and having a substantially circular cross-section. The bulb 2 is substantially spherical-shaped, and has a stem 4 forming a cavity 3 at a center of its inside 2*b*, and an air exhausting pipe 11 provided in the cavity 3. The air exhausting pipe 11 is used to exhaust air in the bulb, and to fill a discharge gas such as mercury in the bulb, and is sealed at a pipe end portion after use. A fluorescent material is coated on an inner surface 2*c* of the bulb 2. Ultraviolet rays radiated by exciting the discharge gas are converted to visible light by this fluorescent material, whereby the bulb emits light.

Figure 2A:
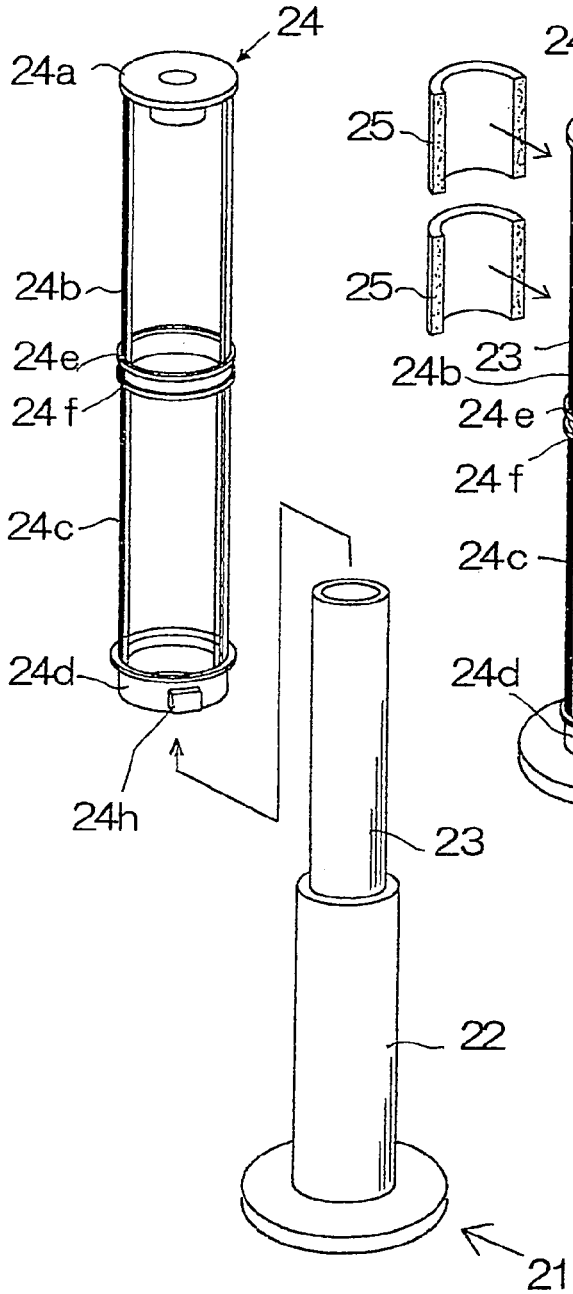
FIG. 2A is a perspective view of a skeleton-shaped bobbin and a cylinder in the same lamp.
Figure 2B:
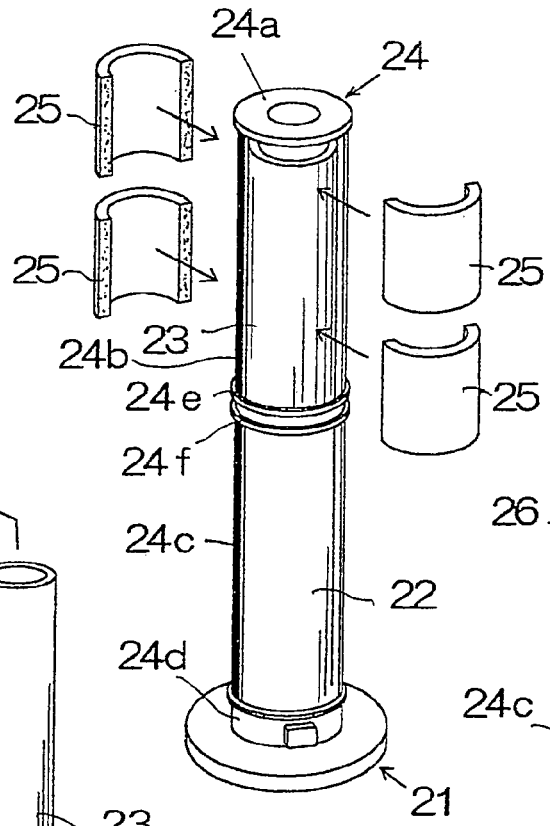
Figure 2C:
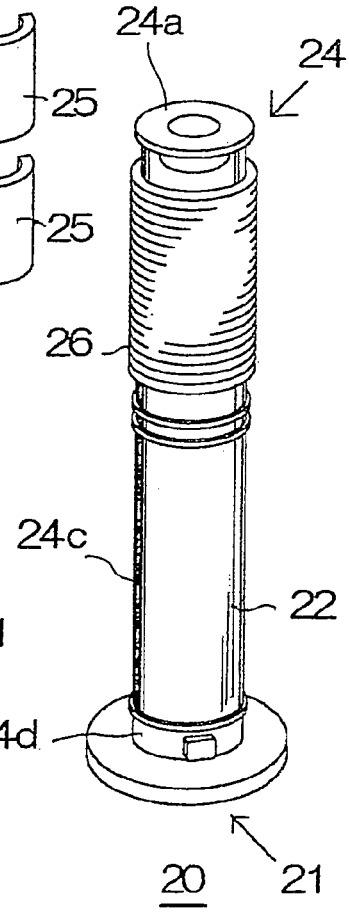
FIG. 2C is a perspective view of a coil assembly body (coupler) with a coil being wound around the surface of the bobbin and the core.

FIGS. 2A, 2B and 2C show a manner of assembling the coupler 20. The coupler 20 comprises: a cylinder 21 formed of a composite body of a copper-made pipe 23 and an aluminum die-cast 22 made of thermal conductor for heat release; a skeleton-shaped resin-made bobbin 24 (hereafter referred to as bobbin) mounted on an outer surface of the cylinder 21 along its axial direction; a ferrite core 25 (hereafter referred to as core) made of a soft magnetic material provided at an opening formed by the skeleton of the bobbin 24 and being in substantial surface contact with the pipe 23 of the cylinder 21; and a coil 26 wound around the surface of the skeleton-shaped bobbin 24 and the core 25. The copper-made pipe 23 has an outer diameter of 15 mm, an inner diameter of 10 mm and a length of 155 mm. The aluminum die-cast 22 is formed of a lower end flange portion and a tubular portion, having an outer diameter of tubular portion of 27.5 mm and a height of 85 mm, and is formed on the periphery of the copper pipe 23 by one-piece molding of molten aluminum.

The bobbin 24 is skeleton-shaped, and has an opening and a hollow portion. By mounting the cylinder 21 in this hollow portion, the copper pipe 23 is brought in a situation facing outwardly through the opening, to the portion of which the core 25 is intimately fixed. The core 25 is in a form of half cylinders to be in intimate contact with the periphery of the copper pipe 23, and has a cross-sectional inner diameter of 15 mm and an outer diameter of 23 mm. The core 25 is arranged to be in total four pieces by intimately arranging a couple pieces in a shape of half cylinders for the upper and lower. This structure enables the core 25 to intimately contact with the copper pipe 23, so that heat from the bulb 2 can be effectively transferred and exhausted to the cylinder 21. An upper end of the core 25 protrudes upward further than an upper end of the copper pipe 23. When referring to a part of the bobbin 24 positioned behind the cavity 3 as a bobbin upper part, and referring to its part positioned at the opening portion as a bobbin lower part, the bobbin comprises: a substantially doughnut-shaped upper collar 24*a*; at least two pillar portions 24*b*, 24*c* extending in a direction from this upper collar 24*a* to the bobbin lower part; and lower collars 24*d*, 24*e*, 24*f* for supporting these pillar portions. These collars and pillar portion 24*b* support the core 25 and the coil 26.

The two pillar portions 24*b*, 24*c* of the bobbin 24 are positioned at a butt-joining portion between the half cylinders of the core 25. After the four pieces of the core 25 are mounted, a magnet wire is wound around to form the coil 26. Thus, first, the wire is pulled out from a lower part to an upper part of the bobbin pillar portions 24*b*, 24*c* along the pillar portions. Thereafter, a glass cloth tape is wrapped around the core 25. The glass cloth tape is heat-resistant to be used to fix the four pieces of the core 25, and to insulate the core 25 from the coil 26 (details described later). Next, the wire pulled out to the upper part is wound 40 times around the glass cloth tape toward the lower part, and the wire is pulled out at a mid-position of the bobbin to the lower part along the pillar portions. Since the coil 26 is formed on the glass cloth tape, it is possible to firmly insulate the wire from the core 25. Using a Litz wire as a wire material of the wire, a stranded wire formed by bundling 19 amide-imide element wires of $\phi 0.12$ was used with a fluoride insulating layer being coated as an outer coating on the stranded wire. By using the Litz wire, it is possible to reduce the coupler loss in a high frequency operation range.

The bobbin 24 is formed by one-piece molding of a heat-resistant resin such as a liquid crystal polymer. When the coupler 20 is inserted into the cavity 3 of the bulb 2, there is a possibility that an upper part of the coupler may touch the air exhausting pipe 11 of the transparent material (e.g. glass) and the opening portion of the cavity of the bulb 2. However, since the upper part of the coupler is the bobbin 24 formed of a resin, it is elastic, and strong against deformation, making it possible to prevent the glass from being damaged or broken. Further, it is possible to prevent the core 25 from contacting the glass, enabling to prevent the core 25 from breaking.

Figure 3A:
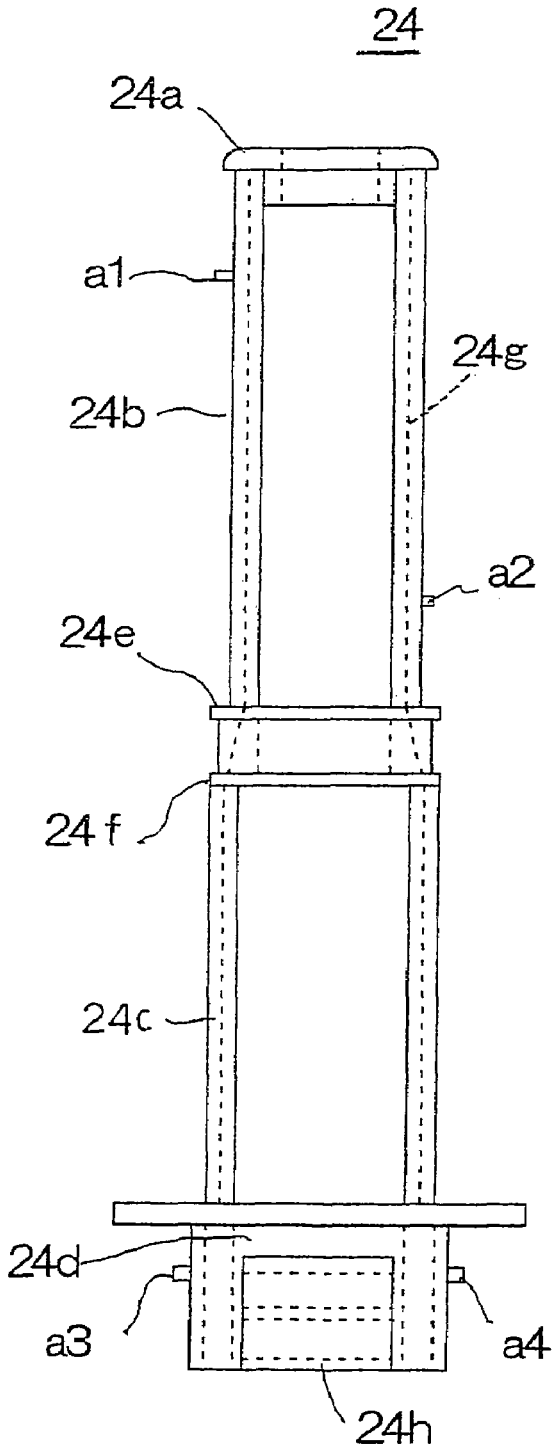
Figure 3B:
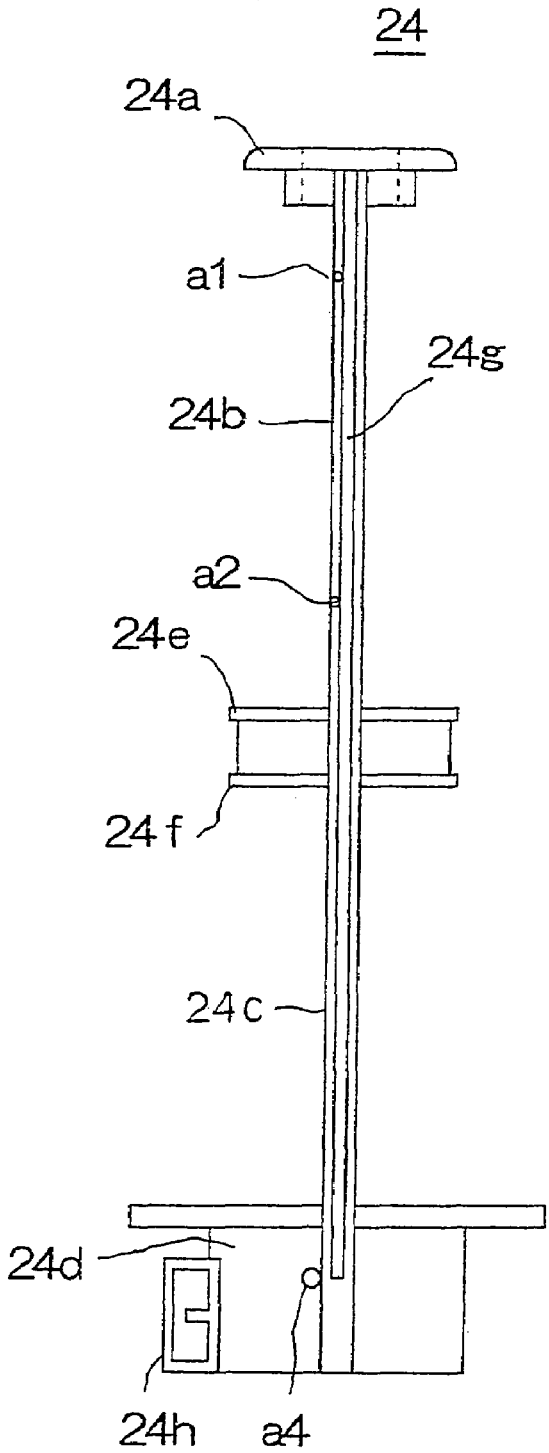
FIG. 3B is a side view of the bobbin.

FIGS. 3A and 3B show a detailed structure of the bobbin 24. The upper collar 24*a* is a collar for positioning an upper end portion of the core 25, and contributes to prevention of core break and stabilization of coil performance. The collars 24*e*, 24*f* are positioned at a boundary between the core 25 and the aluminum die-cast 22 of the cylinder 21. The collar 24*e* has been formed to set the position of an end face of the core 25, and the collar 24*f* has been formed to set the position of a height position of the aluminum die-cast 22. Thereby, the positions of the respective members are determined, and the coil performance can be stabilized. The lower collar 24*d* has a cylindrical shape, and is positioned at a bottom portion of the coupler 20, with a pair-terminal box 24*h* being formed integrally with the bobbin 24. A lead terminal of the coil 26 and a terminal of a lamp cable 28 (tube lighting cable: hereafter referred to as cable) for providing power supply are inserted into and from both sides of the terminal box 24*h*, so as to make their electrical connection. This can be done by forming the lead terminal of the coil 26 as a female terminal, and the power supply cable 28 as a male terminal. Since the terminal box 24*h* is formed on the bobbin 24, the terminal portion can be easily insulated.

The wire of the coil 26 used in the present embodiment is a Litz wire as described above, and the element wire is an amide-imide wire, so that normal electrical connection between the lead line and the terminal using solder based on its melting is difficult. Further, even if the connection can be made by using solder, it cannot satisfy reliability of the connection portion for a long time use, because such portion of the coupler 20 in practical use reaches about 150° C. In the present embodiment, the connection between the terminal and the lead line of the coil 26 was made by mechanically exfoliating the fluorocarbon resin as the outer coating, and thereafter by thermally caulking (fusing) the stranded wire as the bundle of element wires.

As shown in FIGS. 3A and 3B, the pillar portions 24*b*, 24*c* of the bobbin 24 are provided with cylindrical projected portions a1, a2 having a diameter of 1 mm and a height of 1 mm at two locations. Further, the pillar portions 24*b*, 24*c* are provided with grooves 24*g*, having a groove width of 1.2 mm and a depth of 1.5 mm, for containing the coil lead line, while the lower collar 24*d* is provided with projected portions a3, a4, respectively. The coil 26 is pulled out from the upper portion to the bottom portion through the grooves 24*g*, and the lead line can be firmly fixed by being hooked to the projected portions a3, a4 and by being extended to the terminal portion.

Figure 4:
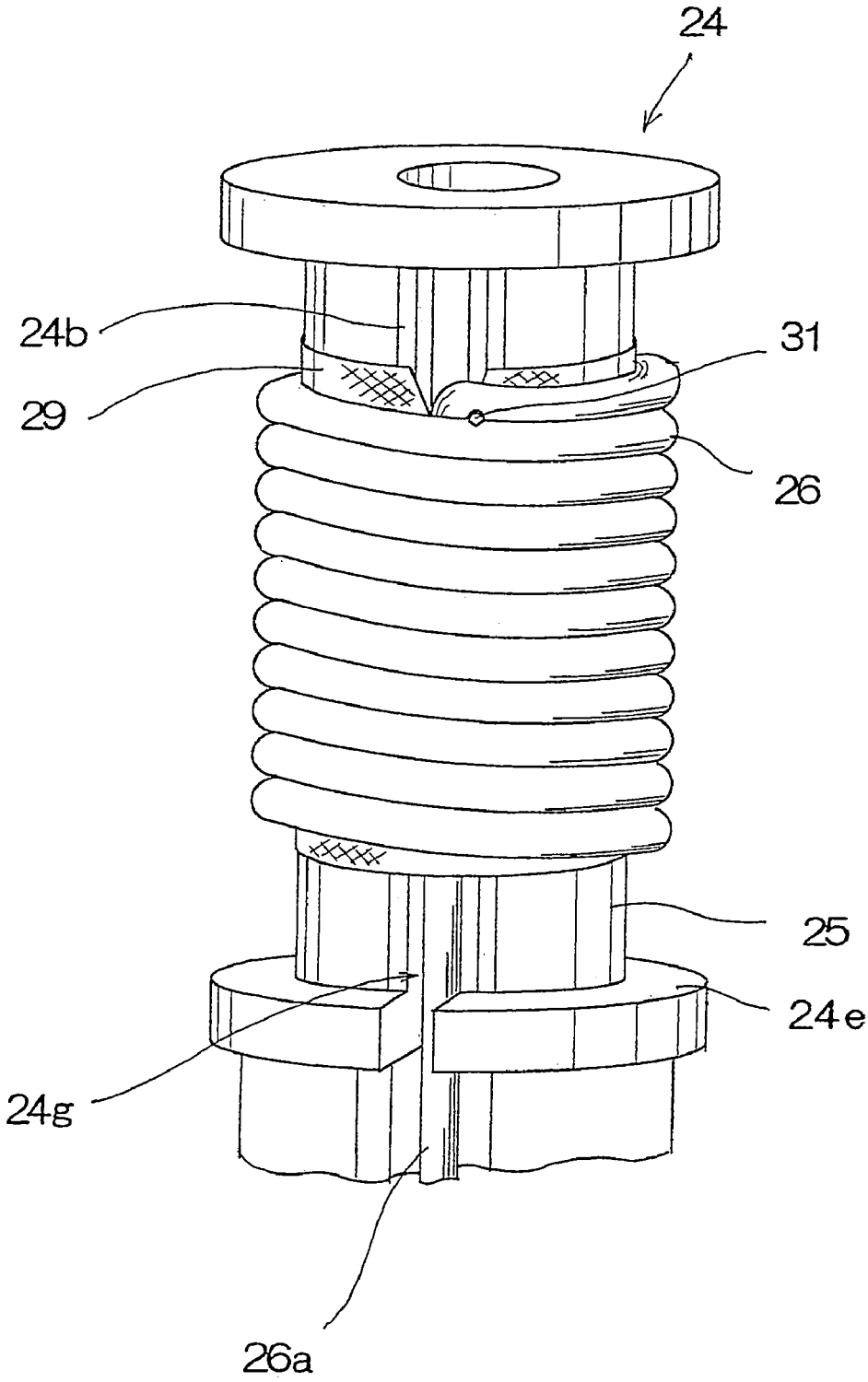
FIG. 4 is a perspective view showing a coil winding structure of the coupler.
Figure 5:
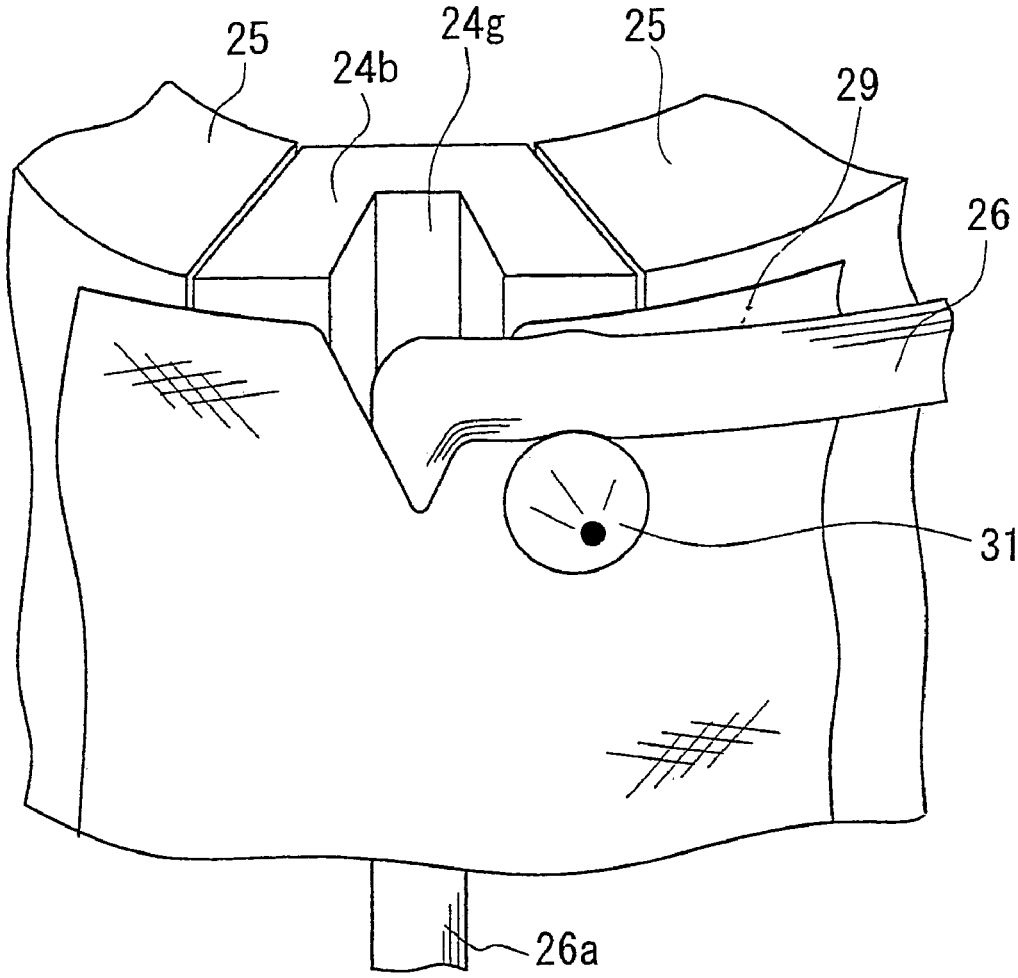
FIG. 5 is an enlarged view of an end portion at beginning of the winding of the coil.

FIG. 4 and FIG. 5 show beginning of the winding of the coil 26 on the bobbin 24. The pillar portion 24*b* of the bobbin 24 is provided with a conical rib 31 (bottom diameter 1 mm, and height 1 mm) formed thereon for guiding the beginning of the winding of the coil 26. This rib 31 is equivalent to the above-described projection portion a1. The lead line (wire) 26*a* of the coil 26 is pulled out upward through a groove 24*g* of the pillar portion 24*b*. In order to ensure its insulation from the core 25, a glass cloth tape 29 (hereafter referred to as tape) is wrapped around peripheral surface of the pillar portion 24*b* and the core 25, and this tape 29 is pressed onto the conical rib 31 to cause such rib 31 to penetrate and project through the tape 29. The tape 29 is partially provided with a notch. The lead line 26*a* is bent by the rib 31, and wound on the tape 29 to form the coil 26. Thus, the insulation of the coil 26 from the guide as well as of the coil 26 from the core 25 can be achieved. This similarly applies to the winding end portion of the coil 26.

Figure 6B:
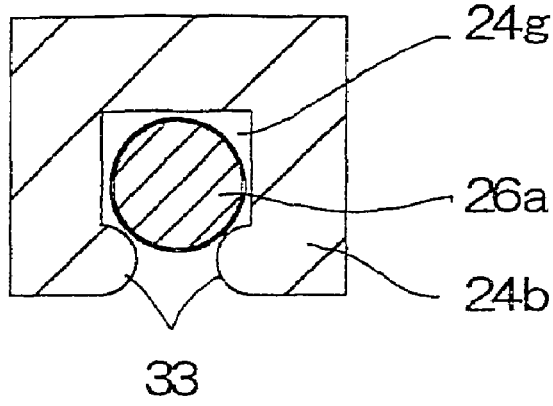
FIG. 6B is its lateral cross-sectional view.
Figure 6A:
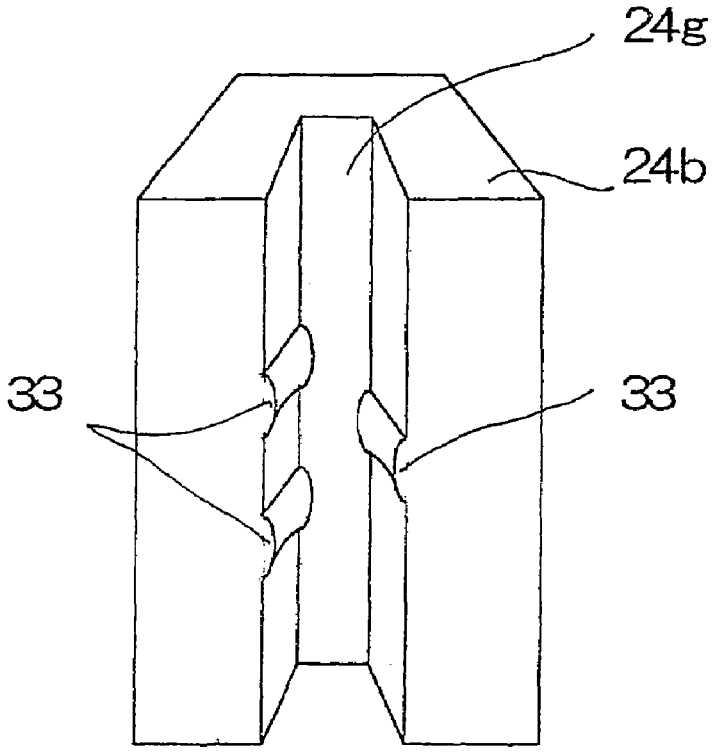

FIGS. 6A and 6B show an exemplary structure of the groove 24*g* provided on the pillar portion 24*b* of the bobbin 24. This groove 24*g* has convex-shaped ribs 33 (height 0.2 mm) formed therein for fixing the lead line 26*a*. Thereby, the lead line 26*a* is contained in a deep portion of the groove 24*g*, and is firmly fixed.

Figure 7:
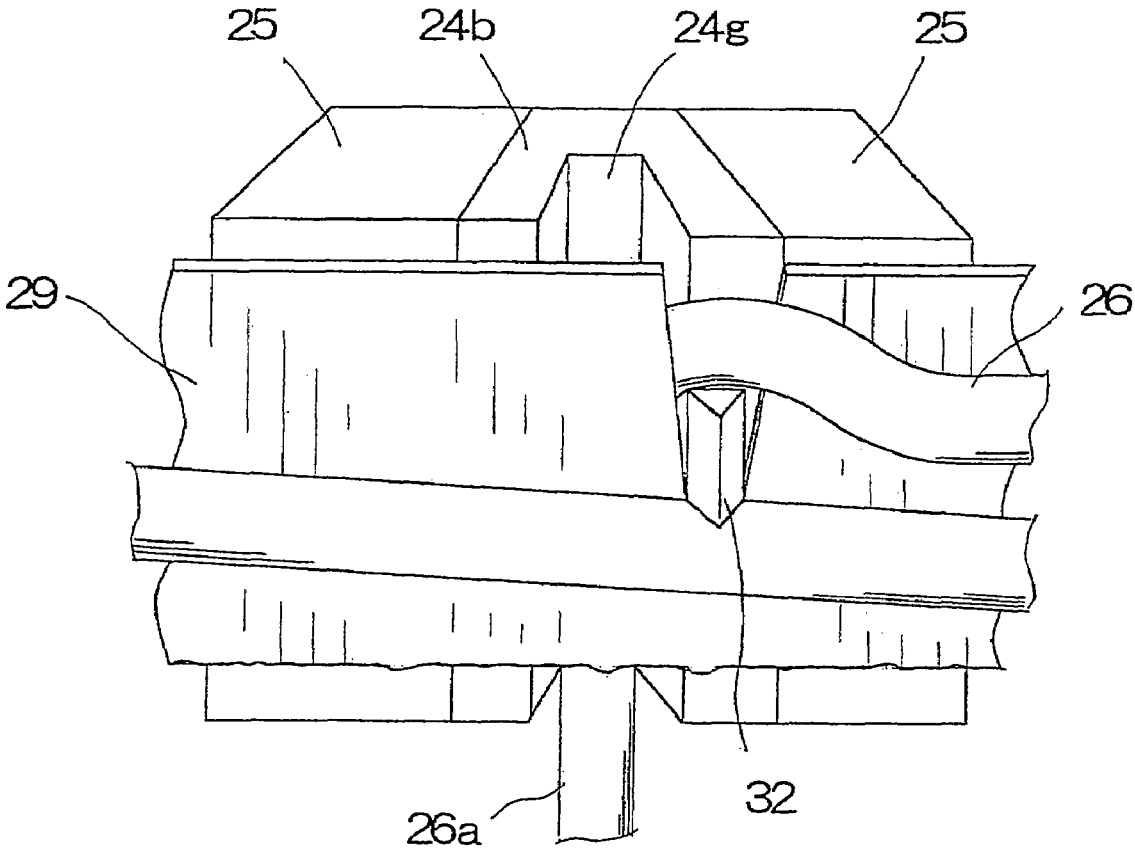
FIG. 7 is an enlarged view of an end portion at beginning of the winding of the coil according to another example.

FIG. 7 shows another exemplary structure at beginning of winding of the coil 26 on the bobbin 24. In this example, an angular prismatic rib 32 is used in place of the conical rib 31, in which the tape 29 is provided with a notch to allow the angular prismatic rib 32 to project through. The lead line 26*a* is wound similarly as described above. Thus, similarly as described above, the insulation of the coil 26 from the core 25 can be ensured by only providing a notch in the tape 29.

Figure 8A:
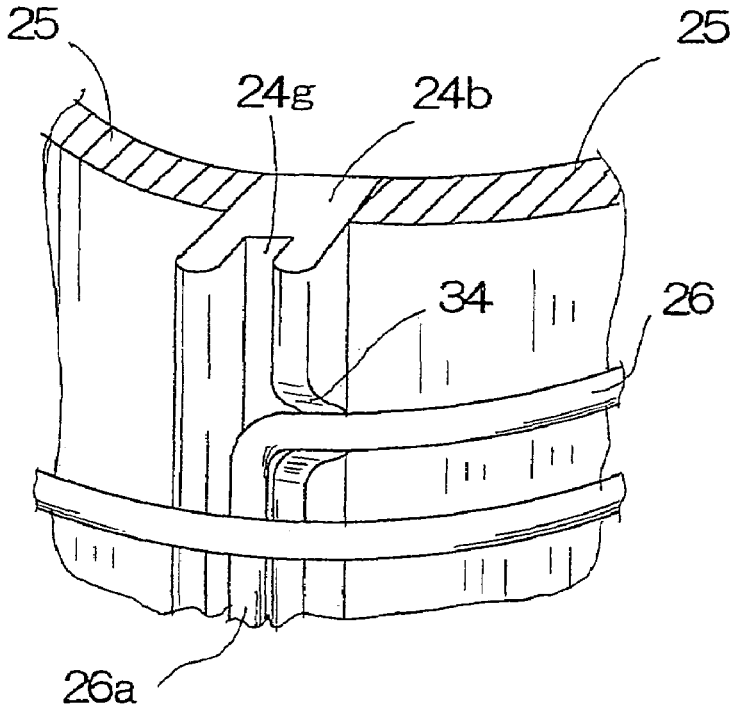
Figure 8B:
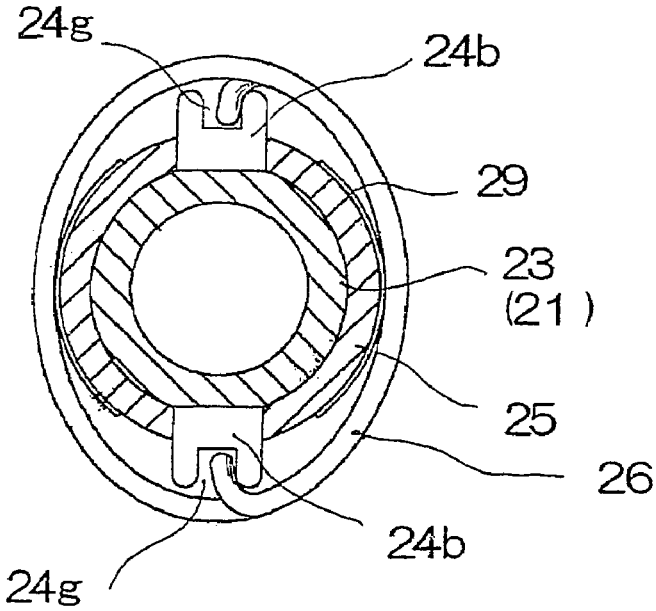
FIG. 8B is a lateral cross-sectional view of the coupler in the case of FIG. 8A.

FIGS. 8A and 8B show still another exemplary structure at beginning of winding of the coil 26 on the bobbin 24. In this example, the pillar portion 24*b* is made higher than the height of the core 25, and is partially provided with a notch 34 to allow the lead line 26*a* of the coil 26 to be taken out from the groove 24*g* through the notch 34 as a beginning of the winding. As shown in FIG. 8B, the beginning of the winding of the coil is insulated with space from the core 25 being maintained. The glass tape 29 should be attached only to a portion where the core 25 and the coil 26 are in intimate contact. This enables insulation only by attaching the tape 29.

Effects According to First Embodiment (1) Heat received by the coil 26 and heat loss generated in the coil 26 can be effectively transferred and exhausted from the core 25 formed of ferrite to the cylinder 21 which is a thermal conductor made of copper and aluminum, thereby making it possible to lower the coil temperature and the ferrite temperature. According to the present embodiment, the maximum temperature of the coil is about 180° C., and the heat-resistant temperature of the wire material of the coil is equivalent to 200° C., in the case where a 150 W equivalent lamp is lit at an ambient temperature of 60° C., so that it sufficiently withstands service life. Further, the maximum temperature of the core 25 is about 160° C., which is sufficiently lower than the Curie temperature of ferrite, 250° C., so that it does not cause any trouble in practical operation. Furthermore, if the material of the bobbin 24 is a liquid crystal polymer having a softening temperature of 250° C., it can be sufficient for practical use from a thermal point of view.

(2) Since the core 25 and the coil 26 are fixed by the bobbin 24 with high positional accuracy, variations in the magnetic properties and the lighting performance are extremely small. If the bobbin 24 is not used, and the core is attempted to be attached to the thermal conductor with an adhesive, for example, misalignment is caused to degrade the positional accuracy when the viscosity of the adhesive is softened at the time of curing the adhesive. Further, since the positions of the beginning and end of the winding of the coil 26 are not controlled, it similarly degrades accuracy. Twenty pieces of couplers 20 according to the structure of the prior art without a bobbin and according to the structure of the present embodiment have been trial-manufactured, and the table below shows results of comparison between their property variations.

| | Prior Art | | Embodiment | |
|---|---|---|---|---|
| | Minimum L Piece | Maximum L Piece | Minimum L Piece | Maximum L Piece |
| Inductance (L) μH | 155 | 180 | 161.6 | 162.6 |
| Coupler Voltage while lit V | 179 | 154 | 167.2 | 166.6 |
| Ferrite Temperature ° C. | 174 | 155 | 160.5 | 155.5 |
| Coil Temperature ° C. | 180 | 172 | 178.6 | 176.4 |

Thus, it is understood that the variations in the respective properties according to the present embodiment are extremely small as compared with the prior art structure. Since a lighting circuit connected to a coupler forms a resonant boost circuit using an inductance L of the coupler, the property variations of the coupler become restrictions on the design. However, the use of the present embodiment enables circuit design with allowances for variations.

(3) The upper end of the core 25 protrudes upward further than the copper pipe 23 of the thermal conductor. In other words, at the upper portion of the core 25, the copper pipe 23 is absent, and there is no magnetic flux shielding medium nearby. Accordingly, the magnetic flux extends sufficiently to link with plasma in the bulb, increasing the light emission efficiency. In the present embodiment, the core 25 formed of the protruded ferrite is protected with the resin bobbin 24, so that it can be avoided from breaking and cracking due to impact. It does not influence on the magnetic flux linkage at all, either.

(4) Since the bobbin pillar portions 24*b*, 24*c* are provided with the grooves 24*g* for pulling out the coil, the insulation is ensured between the coil conductor and the electrical conductors such as the core 25, the copper pipe 23 and the aluminum die-cast 22.

(5) Since the above-described grooves 24*g* have the ribs 33 formed on inner surfaces thereof for fixing the lead line 26*a* of the coil, the lead line 26*a* can be securely contained without being detached from the grooves 24*g*.

(6) Since the resin bobbin 24 is provided with the terminal box 24*h* at a bottom portion thereof for containing terminals, the bobbin can be used to insulate the terminal portion as well.

(7) At the bottom portion of the bobbin, the lead line 26*a* from the lead grooves 24*g* to the terminal portion can be firmly placed along the bobbin surface by using the projected portions a3, a4 provided on the bobbin.

(8) As for the leading at the beginning and end of the winding of the coil 26, the pillar portions 24*b*, 24*c* of the bobbin 24 are provided with the projected portions a1, a2, or the rib 31, 32 or the notch 34, so that it becomes possible to form a coil with high accuracy. Here, by forming the rib to be conical or angular prismatic, it becomes easy to interpose the glass tape 29 between the coil 26 and the core 25, thereby ensuring the insulation. Furthermore, the core 25 can be insulated from the coil 26 with space according to the structure in which the bobbin pillar portion 24*b* is made higher than the core 25, and the lead line 26*a* is pulled out through the notch 34.

(9) The terminal of the coil lead line and the terminal of the cable are connected by thermal caulking without using solder, so that it can withstand long time use at high temperatures, and obtain high reliability.

SECOND EMBODIMENT

Figure 9:
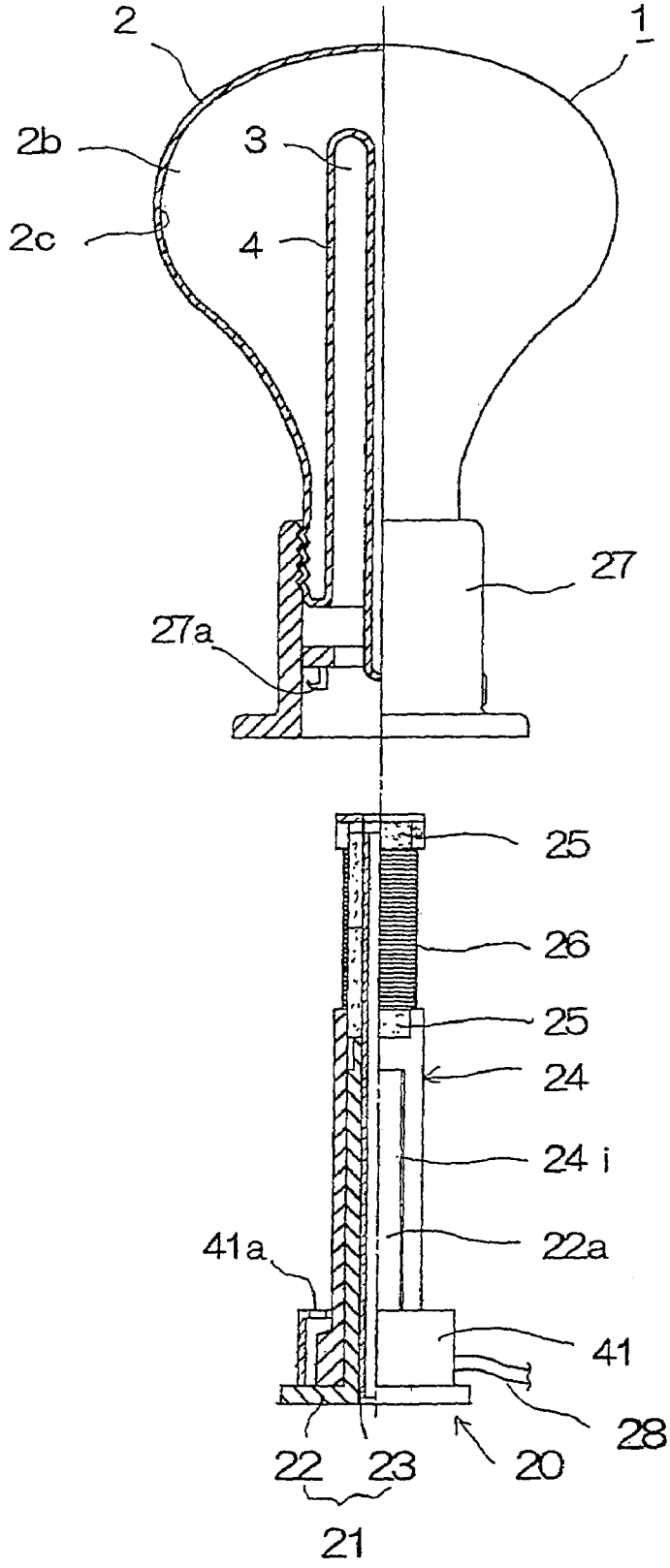
FIG. 9 is a half-cut side cross-sectional view of a bulb and a coupler in an electrodeless discharge lamp according to Second Embodiment of the present invention.

The Second Embodiment is a structure further embodying the above-described First Embodiment. FIG. 9 to FIG. 15 show an electrodeless discharge lamp 1 according to the Second Embodiment of the present invention. Members equivalent to those of the above-described embodiment are designated by like reference numerals. FIG. 9 shows a state where a coupler 20 and a bulb, which are separable and form the electrodeless discharge lamp 1, are separated. The coupler 20 is to be contained in a cavity 3 of a bulb 2, and comprises a cylinder 21, a bobbin 24, a ferrite core 25 and a coil 26, in which the cylinder 21 is provided at its bottom portion with a base receiver 41 to be fitted and fixed to a base 27 of the lamp 1. The cylinder 21 is formed of an aluminum die-cast 22 and a copper pipe 23.

Figure 10A:
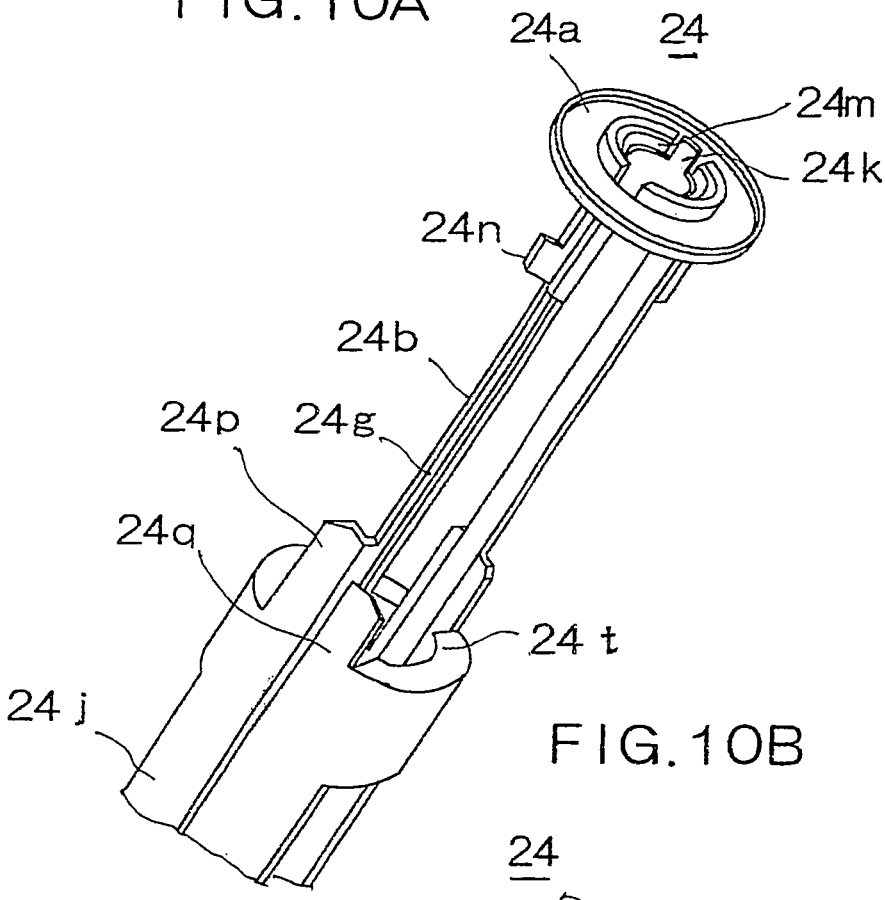
Figure 10B:
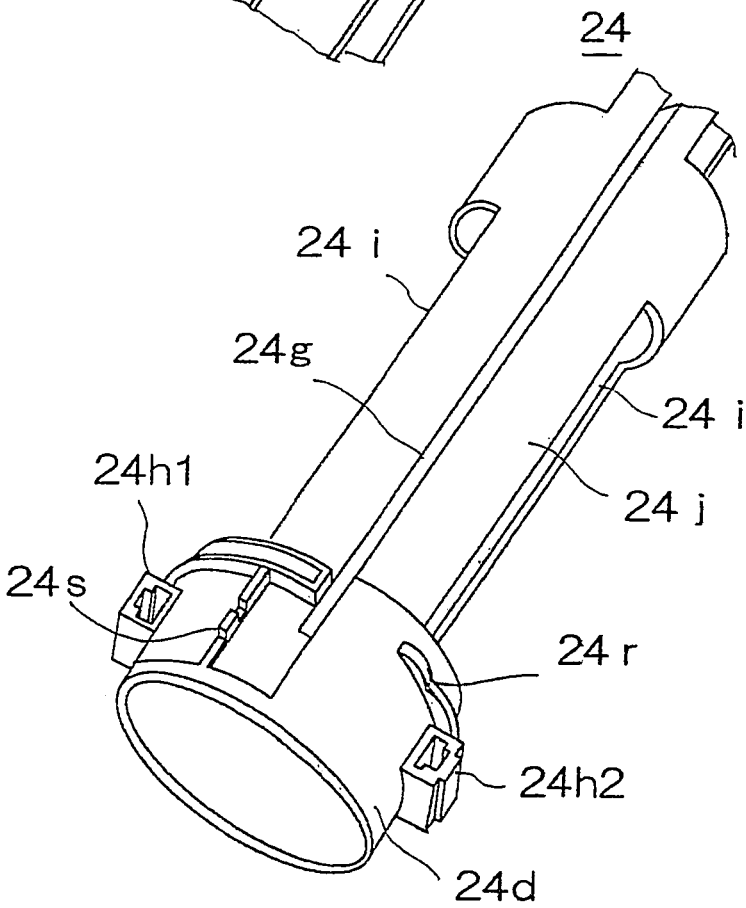
FIG. 10B is a perspective view of a lower half of the same bobbin with a viewing angle being changed from FIG. 10A.
Figure 11:
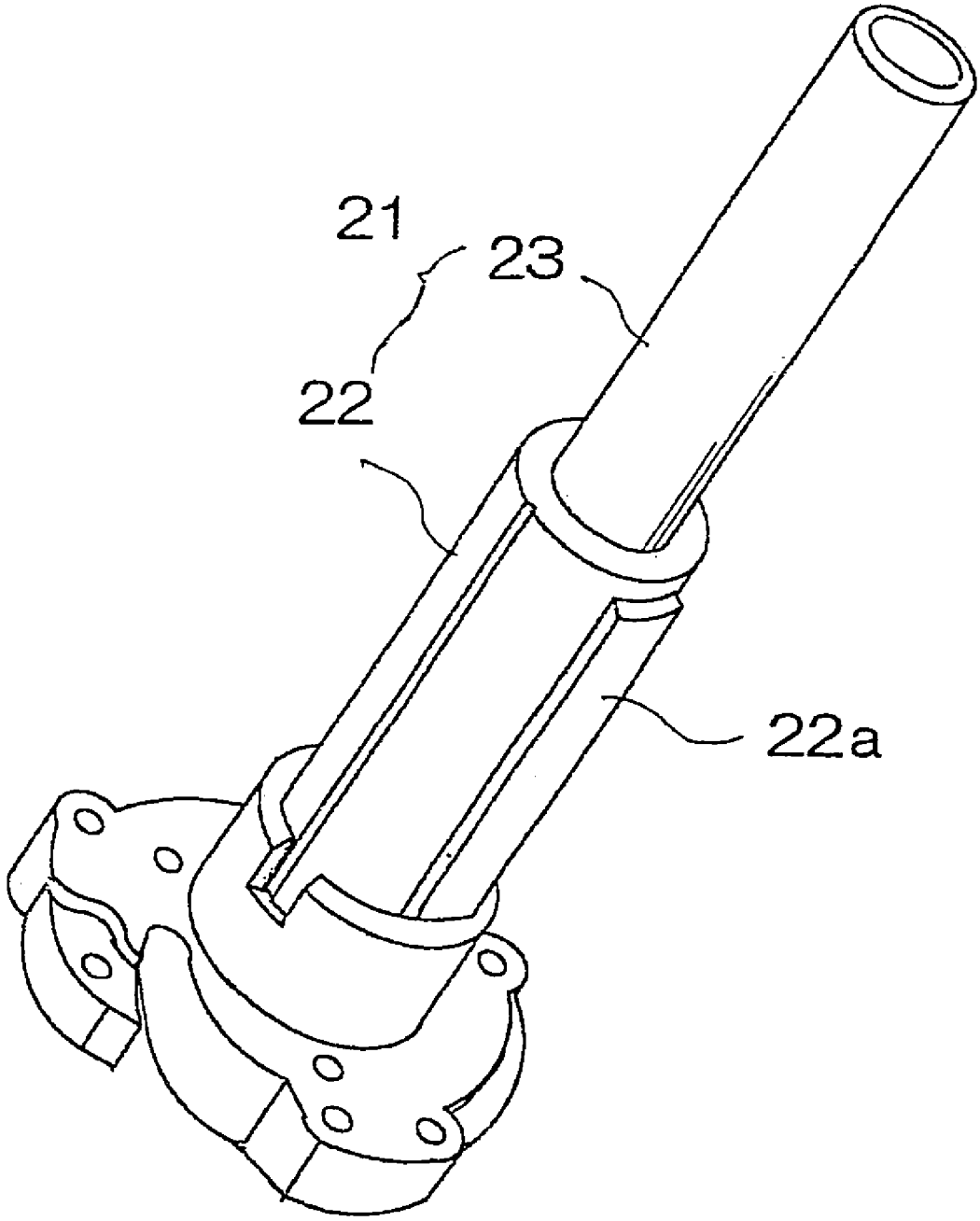
FIG. 11 is a perspective view of a cylinder of the same lamp.
Figure 12:
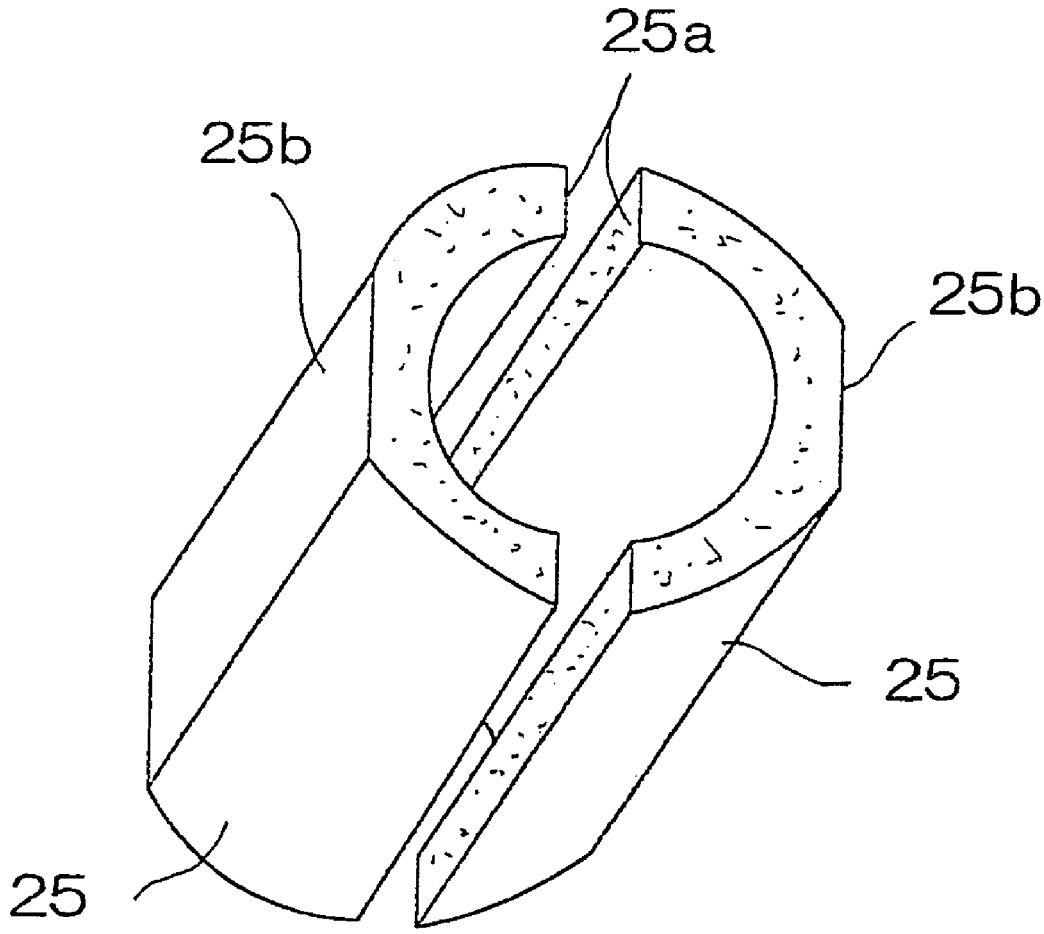
FIG. 12 is a perspective view showing a couple pieces of a core mounted in the same lamp.

FIGS. 10A and 10B show a bobbin 24, and FIG. 11 and FIG. 12 show a cylinder 21 and a ferrite core 25 in a couple (two sets of these being used in the embodiment), respectively. The bobbin 24 uses a material of liquid crystal polymer, and formed in one piece, and fixed by being mounted on convex and concave portions of an aluminum die-cast 22. The bobbin 24 has, on its top portion, a circular upper collar 24*a* for positioning the upper end portion of the core 25, and further has, at this upper collar 24*a*, an opening 24*k* of a central through-hole for inserting an air exhausting pipe of the bulb 2 when the coupler 20 is mounted on the bulb 2 as well as a guide piece 24*m* having a slope in an axial direction of the coupler. When the air exhausting pipe (glass) is mounted on the coupler 20, the air exhausting pipe can be guided by the resin-made collar of the bobbin 24 without contacting the core and the copper pipe, so that the core and the air exhausting pipe can be prevented from being broken and damaged.

The bobbin 24 has a shape of skeleton, having two pillar portions 24*b*, from its upper end portion to its substantially middle portion, on which the divided ferrite core 25 is mounted. The core 25 is arranged such that its inner peripheral surface contacts the outer peripheral surface of the copper pipe 23. The bobbin 24 has, at its portion extending from its substantially middle portion down, wide pillar potions 24*j* having windows 24*i* at opposite positions (referred to as front surface and rear surface) in the circumferential direction, allowing the convex portions 22*a* of the aluminum die-cast 22 to be exposed through the windows 24*i*. A lower collar 24*d* of the bobbin 24 is cylindrical, and has pair-terminal boxes 24*h*1, 24*h*2 formed integrally with the bobbin 24 on the front surface and the rear surface, and further has a projection 24*r* for engagement with the base receiver 41 as well as a rib 24*s* for holding a lead line. The pillar portions 24*b*, 24*j* are provided with grooves 24*g* to insert the lead line of a coil.

As shown in FIG. 11, the aluminum die-cast 22 of the cylinder 21 has convex portions 22*a* protruding by 1 mm in the radial direction of the cylinder at symmetrical positions in the circumferential direction. One of them has a width of 13 mm, and the other 12 mm, which are different from each other. These concaves and convexes are for mounting and fixing the bobbin. The cylinder 21 is one made by inserting the copper pipe 23, having an inner diameter ϕ10 mm, an outer diameter ϕ14 mm and a height 155 mm, into molten aluminum, and thereby forming the aluminum die-cast 22 on the outside. The aluminum die-cast 22 is to have a height of 85 mm, and a bottom outer diameter of 60 mm, roughly. The aluminum die-cast 22 has a flange portion having formed therein a hole for fixing the coupler, a hole for fixing the base receiver, a hole for pulling out the cable, a hole for ground terminal, and so on.

Figure 13:
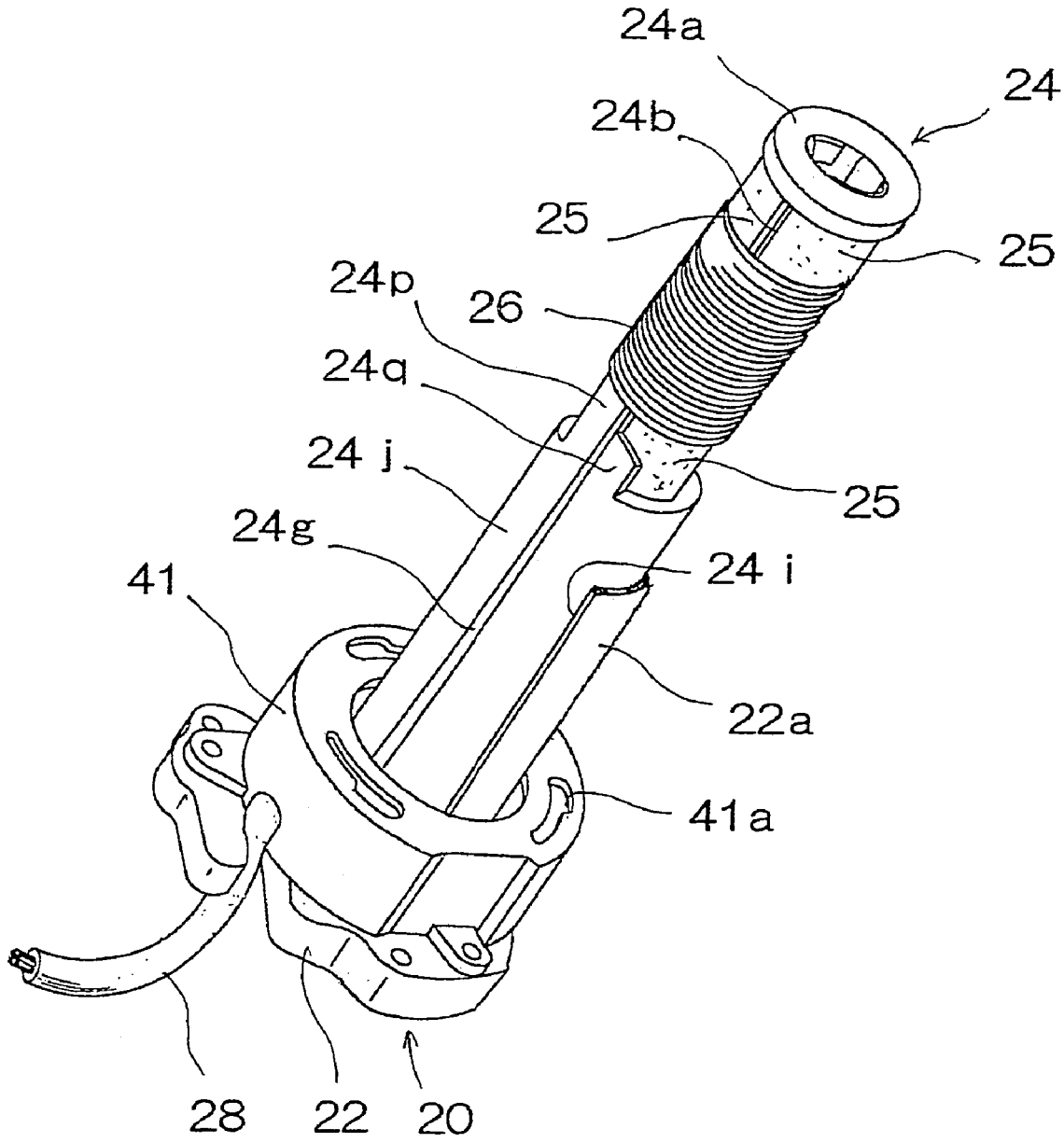
FIG. 13 is a perspective view of a coupler of the same lamp.

FIG. 13 shows the coupler 20, which is an assembly formed by fitting the bobbin 24 and the core 25 into the cylinder 21. The bobbin 24 is fixed with its windows 24*i* being fit to the convex portions 22*a* of the aluminum die-cast 22. Since the convex portions and the windows are different in the respective width dimensions between on the front surface and on the rear surface, the orientation of the fitting is uniquely determined, making the fixing firm. The base receiver 41 is mounted on the flange portion of the aluminum die-cast 22. The core 25 is arranged so as to contact the copper pipe 23 (refer to FIG. 11) exposed in the vicinity of the two pillar portions 24*b* of the bobbin 24, in which the contact with the copper pipe 23 is done using an adhesive.

Four pieces of the core 25 are used in total, a couple pieces for the front and rear, and two for the upper and lower. As shown in FIG. 12, the core 25 is substantially semicircular, and has an inner diameter of 15 mm, an outer diameter of 23 mm and a height of 35 mm, in which butt-joining portions 25*a* are arranged with a distance of 3 mm in order to sandwich the bobbin pillar portions 24*b*. The core 25 uses a material of ferrite, and has flat portions 25*b* at positions 9 mm from the butt-joining portions 25*a* on the rear of the core. The core 25 is a sintered body, and has poor dimensional accuracy, so that it, as is, makes it difficult to obtain the dimension of 3 mm at the butt-joining portions with high accuracy, causing significant variations in intimacy of contact between the core 25 and the copper pipe 23. Thus, the flat portions 25*b* are formed on the rear of the core, and the butt-joining portions 25*a* are polished with the flat portions 25*b* being used as a reference, thereby completing the core 25.

The adhesive between the core 25 and the copper pipe 23 is required to be uniformly coated, but may occasionally reduce its viscosity during heat curing and thereby overflow. In order to release this excessive adhesive, a collar portion 24*t* (refer to FIG. 10A) of the bobbin 24 to receive a lower end part of the core 25 is provided with a notch, and in addition, a gap is provided between the bobbin 24 and the copper pipe 23. This makes it possible to release the adhesive, so that uniform adhesion between the core 25 and the copper pipe 23 can be achieved.

Next, a method of winding the coil 26, after attaching the core 25 to the copper pipe 23, will be described. A lead line at the winding beginning of the coil 26 is pulled out upward from the lower part along a groove 24*g* of the bobbin 24. A wire material of the coil used here is 19 aluminum element wires of $\phi$0.12 which are stranded with a fluororesin being coated as an outer coating. Thereafter, a glass tape (not shown) is wrapped around a portion of the core 25 on which the coil 26 is wound. The glass tape is used for temporary fixing until the adhesive cures, and for secure insulation between the core 25 and the coil 26.

Figure 14A:
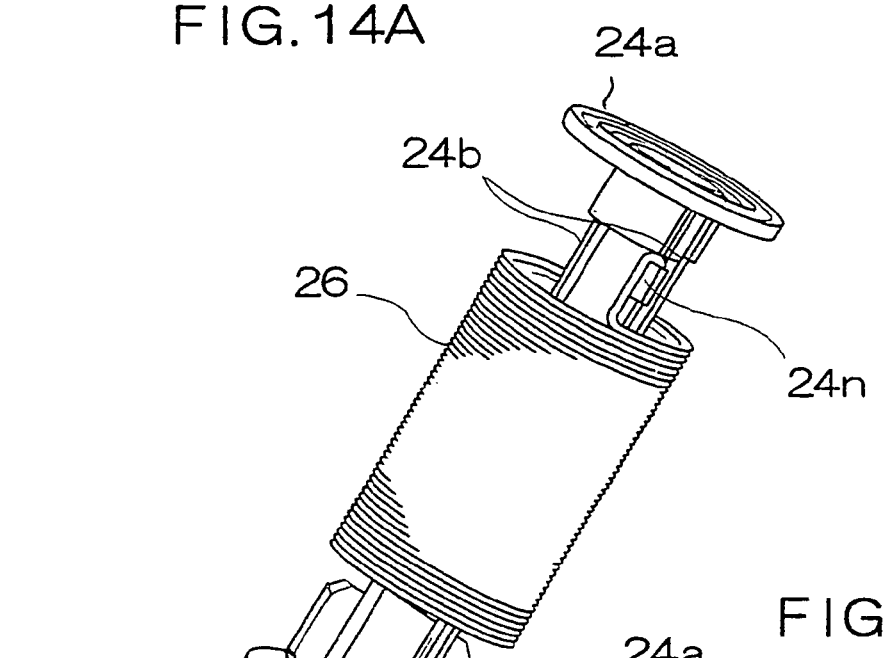

FIG. 14A shows a manner of the beginning of the winding of a coil. For facilitating the description, a showing of a copper pipe and a glass tape is omitted. A lead line 26*a* having been pulled upward is wound once around a rib 24*n* provided adjacent to a groove 24*g* of a bobbin pillar portion 24*b*, and then is wound around the entire periphery of the core. By being wound around the rib 24*n*, the lead line 26*a* from the bobbin groove 24*g* can be securely fixed, and can be easily wound around the core.

Figure 14B:
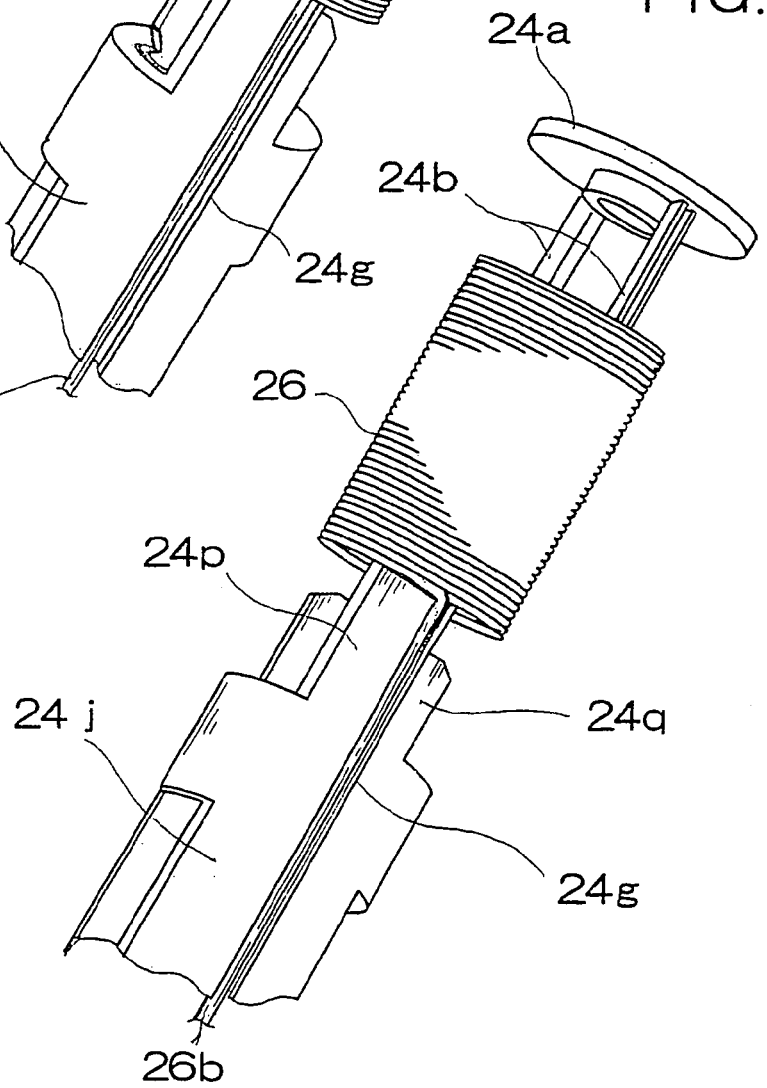
FIG. 14B is a perspective view showing an end portion at end of the winding of the coil (showing of the core being omitted)

FIG. 14B shows a manner of winding end of the coil. A winding end lead line 26*b* is positioned and fixed by using a step between extension portions 24*p*, 24*q* having different height (length) dimensions and formed on the wide pillar portion 24*j* (wall), forming the groove 24*g* opposite to the beginning of the winding, and is bent and contained in the groove 24*g*, and is further pulled out downward along the pillar portion 24*j*. Thereby, the winding end lead line 26*b* can be easily fixed.

Figure 15A:
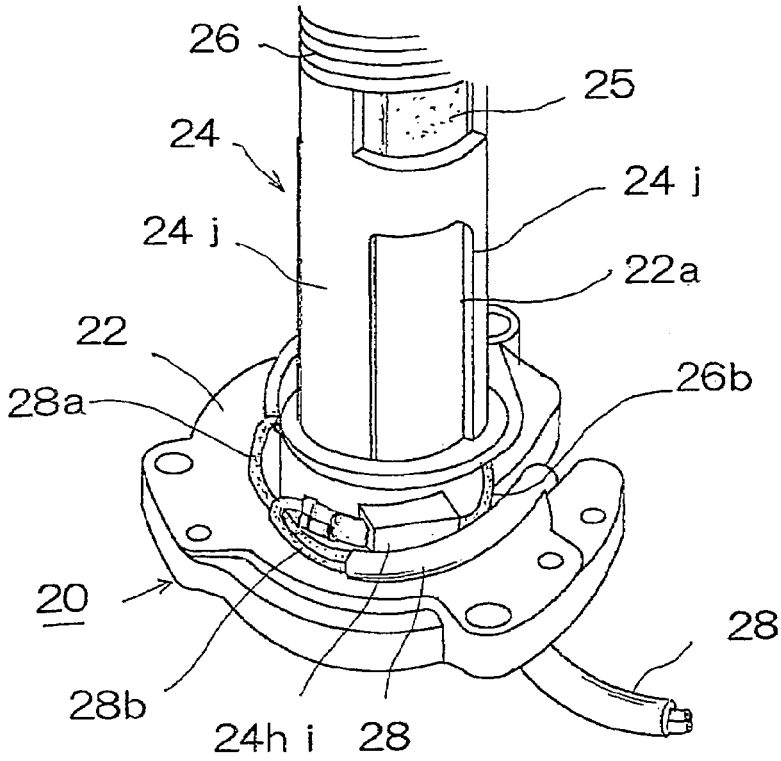
Figure 15B:
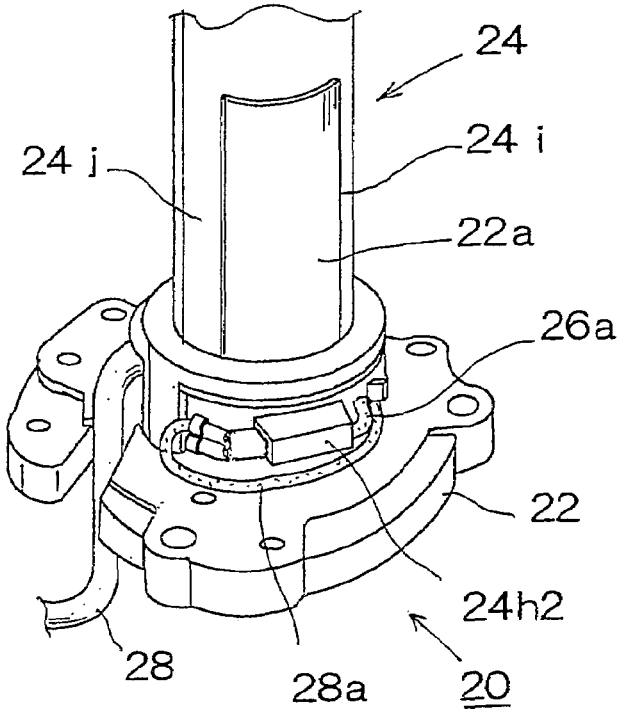
FIG. 15B is a perspective view showing connection of the other coil lead line to the cable.

Next, the connection of the lead lines of the coil 26, at the winding end and winding beginning, to the cable 28 will be described. FIG. 15A and FIG. 15B respectively show connection configurations at the winding end (low voltage side) and the winding beginning (high voltage side). The respective lead lines 26*b*, 26*a* at the winding end and winding beginning have tinned terminals provided at the respective ends thereof, which are electrically connected by fusing (thermal caulking), and are then inserted into the terminal boxes 24*h*1, 24*h*2 from one side. Core wires 28*b*, 28*a* of the cable 28 are caulked and electrically connected at ends thereof to the tinned terminals, and are inserted into the respective terminal boxes from the other side. Thus, the terminal connections between the coil 26 and the cable 28 are made.

The cable 28 is a sheathed cable (two cores) with both of its core wires and outer coating being made of silicon. The cable 28 has been turned clockwise in the drawing and mounted through a notch of the aluminum die-cast 22 at the bottom of the cylinder 21, and the terminal-processed core wires have been inserted from the left sides of the terminal boxes (for both the low voltage side and the high voltage side). Thus, the terminals of the cable core wires are inserted in a direction opposite to the cable mounting direction, so as to have a sufficient strength against the tension of the cable at the time of e.g. construction. Experiments have been able to confirm that a tensile load even ten times as much as the self-weight of the coupler does not influence the terminals.

Next, the base receiver 41 and the base 27 will be described. The base receiver 41 is made of resin, and, as shown in FIG. 13, is mounted on the bobbin 24 and cylinder 21 (refer to FIG. 11), and further has functions of protecting and insulating a charging unit including the coil terminals and the cable terminals, and of fitting the bulb 2 to the base 27. The base receiver 41 has holes 41*a* for fitting to the base, screw holes for fixing to the cylinder 21, an opening for pulling out the cable, and so on. The bobbin 24 passes through the base receiver 41, and is fixed in a manner that the projection 24*r* of the bobbin 24 (refer to FIG. 10B) contacts an inner wall of the base receiver 41. The base 27 is also made of resin, and, as shown in FIG. 9, is mounted on a lower part of the bulb 2, and further has a guide for protecting an air exhausting pipe when mounting the bulb 2 to the coupler 20. The guide is provided with a rib 27*a* for fitting to the base receiver 41. This fitting rib 27*a* is inserted into a hole 41*a* of the base receiver 41, and the bulb 2 is rotated, whereby the bulb 2 can be easily coupled to the coupler 20.

Effects According to Second Embodiment

According to the Second Embodiment, the following effects can be obtained in addition to the effects obtained by the First Embodiment described above:

(1) The coupler 20 is designed to have a structure in which the convex portions 22*a* of the cylinder 21 fit to the windows 24*i* of the bobbin 24, so that the bobbin 24 is prevented from positional misalignment with the cylinder 21, making it possible to strongly fix them both. Further, the convex portions 22*a* and the windows 24*i* form pairs, front and rear, in the circumferential direction of the coupler, and in addition, are slightly different in width dimension, so that the mounting orientation of them both is uniquely determined.

(2) Since the bobbin 24 is provided, at the upper collar 24*a* thereof, with a guide piece 24*m* for guiding the air exhausting pipe of the bulb 2, it is easy to mount the bulb, and the air exhausting pipe does not contact the copper pipe 23 or the core 25, preventing breaking of the air exhausting pipe, damage of the core, and so on.

(3) Since the flat portions 25*b* are formed on the rear of the core 25 which is in a form of half cylinders, polishing of the butt-joining portions 25*a* of the core 25 can be easily done, improving the accuracies of the butt-joining dimensions of the core 25 to the copper pipe 23 and the joining dimension. This improves the thermal conductivity, preventing variations in performance such as temperature rise, and improving productivity.

(4) Since it is designed to release excessive adhesive when intimately contacting the bobbin 24 with the core 25 and the copper pipe 23, a uniform adhesive layer can be formed.

(5) It is designed that a rib 24*n* for holding a lead line is provided adjacent to the groove 24*g* of the bobbin pillar portion 24*b* at the winding beginning position of the coil 26, and that the line is wound therearound, and thereafter its winding is done. This ensures the fixing of the line at the beginning of the winding, and can prevent the winding from loosening.

(6) It is designed that the bobbin 24 is provided with a step between the extension portions 24*p*, 24*q* at the winding end position of the coil 26, and that the lead line is guided thereby. This makes it possible to pull out the line easily without loosening.

(7) Since the connection of the terminals of the cable 28 is made such that the pulling-out direction of the cable is opposite to the terminal insertion direction into the terminal boxes, the terminals are prevented from being disconnected even when the cable 28 is pulled.

(8) Since the bobbin 24 is provided with the engaging projection 24*r* for engagement with the base receiver 41, it is possible to firmly fix the base receiver 41 to the bobbin 24 and the cylinder 21.

The present invention is not limited to the above-described embodiments, and various modifications are possible. For example, although the bulb shown in the above descriptions has a structure having an air exhausting pipe, it can be applied to a bulb without an air exhausting pipe. Further, although the bobbin of the skeleton is shown to be a one-piece molded product, it can be one formed by assembly.

The invention claimed is:

1. A coil assembly body structure for an electrodeless discharge lamp, comprising:

an airtight container bulb of a transparent material and enclosing a discharge gas; and a coil assembly body contained in a hollow portion provided in the airtight container bulb, for generating a high frequency electromagnetic field by conducting a high frequency current in a coil to excite the discharge gas so as to emit light, wherein the coil assembly body comprises:

a pipe-shaped cylinder of a thermal conductor for heat release;

a skeleton-shaped bobbin of a substantially cylindrical shape that includes a side surface and mounted on an outer surface of the pipe shaped cylinder along an axial direction of the pipe shaped cylinder, the skeleton-shaped bobbin including an opening extending radially through the skeleton-shaped bobbin at the side surface of the sugbstantially cylindrical shape;

a core of a soft magnetic material provided at the opening the of skeleton-shaped bobbin and being in substantial surface contact with the cylinder; and a coil wound around a surface of the skeleton-shaped bobbin and the core.

2. The coil assembly body structure for an electrodeless discharge lamp according to claim 1, wherein the skeleton-shaped bobbin of the coil assembly body comprises resin, wherein a part of the skeleton-shaped bobbin positioned in the hollow portion comprises a bobbin upper part, and a part of the skeleton-shaped bobbin positioned at an opening portion of the hollow portion comprises a bobbin lower part, the skeleton-shaped bobbin further comprises: a substantially doughnut-shaped upper collar; at least two pillar portions extending in a direction from the substantially doughnut-shaped upper collar to the bobbin lower part; and a cylindrical lower collar supporting the pillar portions and extending to the bobbin lower part, wherein the substantially doughnut-shaped upper collar, the pillar portions and the cylinderical lower collar support the core and the coil.

3. The coil assembly body structure for an electrodeless discharge lamp according to claim 2, wherein at least one of the collars of the skeleton-shaped bobbin is positioned facing an end of the core, and at least one of the collars protrudes further than a thickness of the core, or protrudes further than a maximum diameter of the coil, in a radial direction of the coil assembly body.

4. The coil assembly body structure for an electrodeless discharge lamp according to claim 2, wherein the pillar portions and the cylinderical lower collar of the skeleton-shaped bobbin are partially provided with a groove configured to receive a lead line of the coil.

5. The coil assembly body structure for an electrodeless discharge lamp according to claim 4, the groove includes a fixation rib provided on an inner wall of the groove to fix the lead line of the coil contained in the groove provided in the skeleton-shaped bobbin.

6. The coil assembly body structure for an electrodeless discharge lamp according to claim 4, wherein the groove provided in the skeleton-shaped bobbin is partially provided with a notch to fix a beginning of winding of the coil, and to insulate the coil from the core.

7. The coil assembly body structure for an electrodeless discharge lamp according to claim 4, wherein an insulating tape is wrapped around a periphery of the core, and the coil is wound thereon, while one of a conical and an angular prismatic rib for bending and fixing the lead line is provided on a pillar portion of the skeleton-shaped bobbin adjacent to the groove at a beginning of the winding of the coil.

8. The coil assembly body structure for an electrodeless discharge lamp according to claim 4, wherein a step is provided on a pillar portion of the skeleton-shaped bobbin between a length dimension of walls forming the groove of the pillar portion in order to bend and receive, in the groove, the lead line at an end of the winding of the coil.

9. The coil assembly body structure for an electrodeless discharge lamp according to claim 2, wherein the airtight container bulb has an air exhausting pipe in the hollow portion, and a projection having a slope, which comprises a guide for mounting the coil assembly body in the hollow portion of the bulb, is provided at the substantially doughnut-shaped upper collar of the skeleton-shaped bobbin.

10. The coil assembly body structure for an electrodeless discharge lamp according to claim 2, wherein notch windows are provided on a cylindrical surface of the cylinderical lower collar of the skeleton-shaped bobbin, while convex portions are provided at corresponding positions of the pipe-shaped cylinder, in which the notch windows and the convex portions are provided in pairs, and their respective width dimensions are different.

11. The coil assembly body structure for an electrodeless discharge lamp according to claim 2, wherein:

the cylinderical lower collar of the skeleton-shaped bobbin has a terminal box provided on a cylindrical outer periphery thereof;

terminals extend into and out of both sides of the terminal box in a circumferential direction so as to electrically connect the lead line of the coil to a lamp cable; and an insertion direction of the lamp cable is opposite to a pulling out direction of the cable.

12. The coil assembly body structure for an electrodeless discharge lamp according to claim 2, wherein the skeleton-shaped bobbin is provided with a base receiver which passes therethrough and is mounted thereon, and the base receiver has a hole provided on an upper surface thereof for being rotationally fitted to a base of the air-tight container bulb.

13. The coil assembly body structure for an electrodeless discharge lamp according to claim 1, wherein the core comprises a ferrite core divided radially, and having flat portions on a rear thereof.

14. The coil assembly body structure for an electrodeless discharge lamp according to claim 1, wherein the core protrudes upward further than the pipe-shaped cylinder at an upper part of the coil assembly body.

15. The coil assembly body structure for an electrodeless discharge lamp according to claim 1, the skeleton-shaped bobbin comprising a substantially circular upper collar and a substantially circular lower collar, a plurality of pillar portions extending between the substantially circular upper and lower collars, an area between the substantially circular upper and lower collars and between adjacent pillar portions defining the opening.

16. The coil assembly body structure for an electrodeless discharge lamp according to claim 1, the skeleton-shaped bobbin comprising a hollow cylindrical member and the opening comprising a majority of the surface area of the hollow cylindrical member.

17. The coil assembly body for an electrodeless discharge lamp according to claim 1, the core being configured to cover the opening of the skeleton-shaped bobbin.

18. The coil assembly body for an electrodeless discharge lamp according to claim 1, the coil being positioned outwardly of the core and of the skeleton-shaped bobbin.

19. The coil assembly body for an electrodeless discharge lamp according to claim 1, the skeleton-shaped bobbin configured to support the core.

20. The coil assembly body structure for an electrodeless discharge lamp according to claim 1, the core being configured to support the coil.

* * * * *